United States Patent [19]

Ives

[11] Patent Number: 5,067,267

[45] Date of Patent: Nov. 26, 1991

[54] QUICK-DETACHABLE SECURITY-TYPE SLING SWIVEL

[75] Inventor: Robert K. Ives, Corbett, Oreg.

[73] Assignee: Michaels of Oregon Co., Portland, Oreg.

[21] Appl. No.: 611,165

[22] Filed: Nov. 9, 1990

[51] Int. Cl.[5] ..... F41C 23/02

[52] U.S. Cl. ..... 42/85; 24/2.5; 224/150

[58] Field of Search ..... 224/150; 42/85; 24/2.5

[56] References Cited

U.S. PATENT DOCUMENTS

| | | | |
|---|---|---|---|
| 3,704,537 | 12/1972 | McKinzie | 42/85 |
| 4,209,157 | 6/1980 | Edmisten | 42/85 |
| 4,454,675 | 9/1984 | Ives | 42/85 |
| 4,505,012 | 3/1985 | Johnson | 24/2.5 |
| 4,841,658 | 6/1989 | Katsenes | 42/85 |

*Primary Examiner*—David H. Brown

*Attorney, Agent, or Firm*—Chernoff, Vilhauer, McClung & Stenzel

[57] ABSTRACT

A swivel for attaching a sling to a firearm including a plunger depressible for quick detachment of the swivel from the firearm and a selectively operable retainer movably mounted on the plunger for locking the swivel to the firearm when moved to an operative first position. In the operative first position, the retainer is rotatable on a smaller diameter portion of the plunger without being compelled into axial movement therealong, but can be manipulated into a mated position with a threaded larger-diameter portion of the plunger and then into an opposed position where an enlarged head on the plunger opposes a resiliently expansible tapered sleeve on the retainer. With progressively increasing torque, the retainer is then advanceable to an inoperative second position that permits sufficient depression of the plunger to allow release the swivel from the firearm.

6 Claims, 3 Drawing Sheets

QUICK-DETACHABLE SECURITY-TYPE SLING SWIVEL

BACKGROUND OF THE INVENTION

The present invention relates to the field of sling swivels for attaching a sling to a firearm and, in particular, to such swivels which quickly detach from a conventional mounting base on the firearm through manipulation of a depressible plunger.

A particular type of quick-detachable sling swivel, having a security feature, is described in Ives, U.S. Pat. No. 4,454,675. In its preferred embodiment, this swivel includes a main body, a loop portion carrying the sling, and a projecting pin that can be inserted into an opening formed in the mounting base of the firearm. To detach the swivel from the firearm, a gate operably mounted on the main body is selectively moved from its normal position surrounding the projecting end of the pin to an open position clearing the pin so that the pin is removable from the base. More particularly, a rear portion of a spring-biased plunger, extending outwardly from a central bore in the main body, operates the gate, which is joined to a forward end of the plunger. To secure or lock the swivel to the firearm, the rear portion of the plunger is externally threaded and a hollow internally-threaded mating sleeve is rotatably movable to an activated position therealong, so that despite depression of the plunger the gate is unable to shift sufficiently to clear the end of the pin.

In the security-type swivel described above, however, if the threaded sleeve element is not screwed tightly enough into its activated position, it might become loosened and be turned incrementally down a sufficient length of the rear portion of the plunger to permit the plunger to be depressed far enough to enable the swivel to be detached from the firearm unintentionally.

During manufacturing, to assembly the described security-type swivel, it is first necessary to screw the threaded sleeve along some preliminary length of the rear portion of the plunger, so that upon insertion of the plunger through the central bore, the forward end of the plunger will project sufficiently from the bore to allow attachment of the gate. The screwing operation involved requires repeated turning movement of the threaded sleeve element on the rear portion of the plunger and is a labor-intensive task that increases manufacturing expense for each unit.

Accordingly, it is an object of the present invention to provide a quick-detachable security-type sling swivel which can be inexpensively assembly without performing labor-intensive screwing-type operations.

A further object of the present invention is to provide a quick-detachable sling swivel which has a secure configuration for preventing accidental detachment of the swivel from the firearm and which includes a mechanism for preventing unintentional removal from the secure configuration.

SUMMARY OF THE PRESENT INVENTION

In achieving the aforementioned objects, the present invention includes a security element mounted on the rear portion of the plunger which, although rotatable relative to the plunger similarly to the sleeve in the above-described prior art construction, is initially activated by movement to an operative first position on the rear portion of the plunger where its rotational movement is independent of its axial movement. The security element can then move incrementally rotationally, in either direction, in response to brushing contact with its surroundings, without being compelled into axial movement that would shift the security element inadvertently to its inoperative position. During assembly, the security element can be slipped onto the rear portion of the plunger and will slide axially into the first position, leaving enough clearance to mount the plunger on the body of the swivel without the necessity of a preliminary screwing operation.

In a preferred embodiment of the present invention, the rear portion of the plunger shaft includes a smaller-diameter portion and a threaded larger-diameter portion, and the security element includes a threaded bore which engages the threaded larger-diameter portion when the security element is in its inoperative second position and which loosely surrounds the smaller-diameter portion when the element is in its operative first position.

Preferably, the plunger shaft further includes an enlarged head and the security element includes a hollow skirt with an elastically expansible tapered interior. The enlarged head interferingly engages the tapered interior before the security element is fully advanced to the inoperative second position thereby requiring a conscious increase in effort by the user to release the security element.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
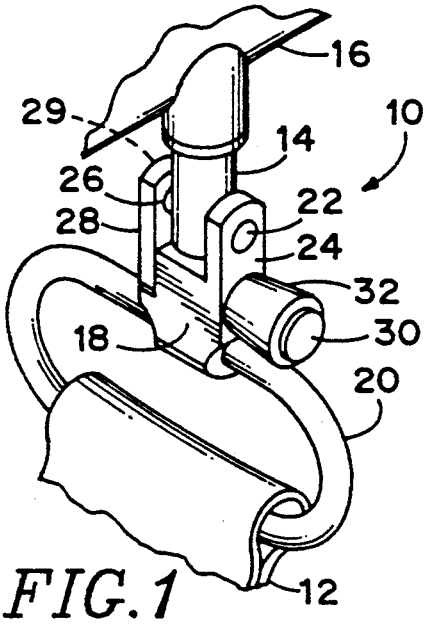
FIG. 1 is a perspective view of an exemplary sling swivel, in accordance with the present invention, mounted on the underside of a firearm stock and carrying a sling, the stock and sling being shown in fragmentary view.
Figure 6:
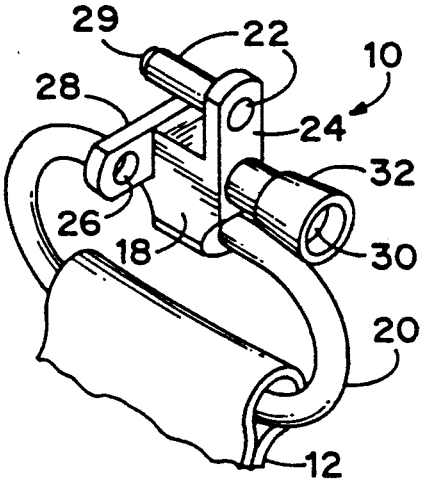
FIG. 6 is similar to FIG. 1, except that the swivel is shown after being opened and removed from the firearm stock.

FIG. 1 shows an exemplary quick-detachable security-type sling swivel 10 constructed in accordance with the present invention for attaching a sling 12 to a conventional mounting base 14 which is screwed into the stock 16 of a firearm. More specifically, the swing swivel 10 includes a main body 18, a ring member 20 pivotably connected to the underside of the main body receiving a strap portion of the sling 12, and a pin 22 forwardly projecting from an upper extension 24 on the main body and dimensioned for sliding insertion into an opening (not shown) formed through the mounting base 14. A passage 26 formed in a gate 28 surrounds and closes off a forward end 29 of the pin to keep the swivel on the mounting base. Although the swivel 10 is shown in locked condition in FIG. 1, after certain manipulation explained below, the gate 28 can be shifted by a plunger 30 and swung away from the end 29 of the pin 22 to permit the swivel to be removed from (or attached to) the mounting base, as shown in FIG. 6. A security element or retainer 32 carried on the plunger 30 determines the range of operation of the plunger 30 and gate 28 and, accordingly, determines whether the swivel 10 can be unlocked from the mounting base 14.

Figure 2:
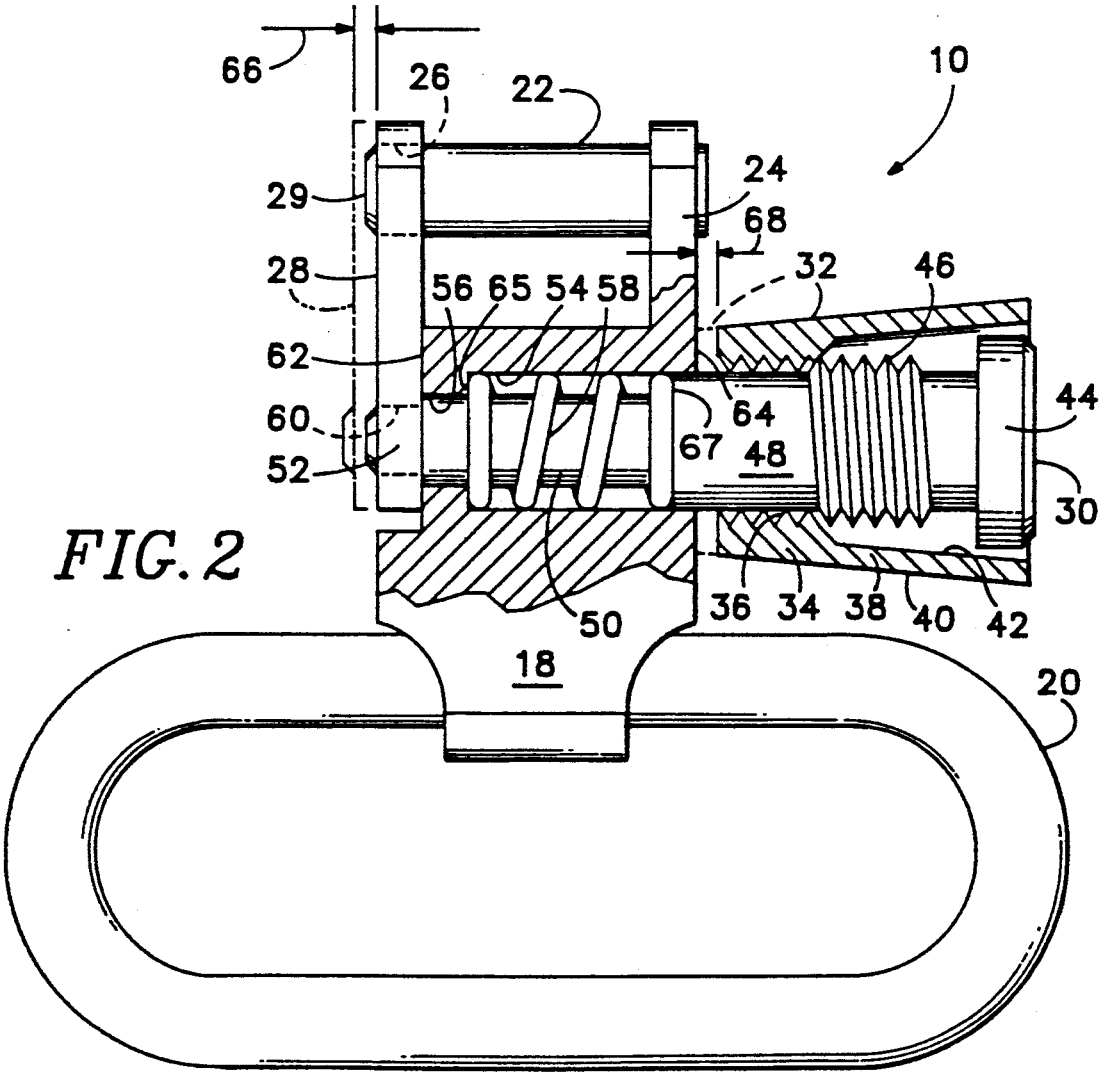
FIG. 2 is an enlarged side elevational view of the exemplary sling swivel shown in FIG. 1 with portions broken away to illustrate interior details and with phantom lines indicating movable parts of the swivel.

Referring to FIG. 2, the exemplary retainer 32 is preferably of hollow frustoconical form and includes a forward portion 34 defining an internally-threaded bore 36 and a rearwardly-extending skirt or sleeve portion 38. The sleeve portion 38 has a tapered exterior 40 and a tapered interior 42 that converge toward the forward portion 34. Preferably, the retainer is molded in one piece of a suitably strong plastic material, and the sleeve portion is sufficiently thin between its interior and exterior to be radially elastically expansible. The tapered character of the sleeve exterior 40 facilitates release of the retainer from the mold while the tapered character of the sleeve interior 42, as will be explained in greater detail, assists in retarding the movement of the retainer towards its inoperative position. The tapered exterior 40 is knurled, as indicated in FIGS. 1 and 6, for ease of grasping by the swivel user.

The exemplary swivel 10 further includes a plunger 30 of stepped-diameter construction, as shown in FIG. 2. The plunger includes, in order of decreasing shaft diameter, an enlarged head 44, a larger-diameter fine-pitched threaded portion 46, a smooth-faced, smaller-diameter portion 48, a central portion 50, and a nub portion 52. The plunger 30, the main body 18, and the other individual parts of the swivel 10, excepting the retainer 32, are preferably made of metal alloy.

The main body 18 of the exemplary swivel 10 includes a larger and smaller diameter bore, 54 and 56, centrally formed therein, as shown in FIG. 2. Before mounting the plunger 30 on the main body, the retainer 32 is slipped facing the direction shown over the smooth-faced smaller diameter portion 48 of the plunger 30 and a helically-coiled compression spring is slipped over the central portion 50. Then the plunger is slidably inserted through the larger and smaller diameter bores, 54 and 56, formed in the main body 18, until the nub portion 52 of the plunger is exposed, where it is placed into a lower opening 60 and riveted or otherwise joined to the gate 28.

It will be recognized that during assembly of the plunger with the main body, there is no need to advance the retainer 32 axially along the plunger with preliminary twisting or screwing movements. Instead, when the nub portion 52 emerges from the forward face 62 of the main body 18, there is a sufficient length of the smooth-faced, smaller-diameter portion 48 projecting from the rear face 64 of the main body for the retainer to slide freely out of the way, without turning. Assembly of the swivel 10 is then completed by attaching the ring member 20 and pin 22 to the main body 18 in the conventional manner.

As represented in solid lines in FIG. 2, the plunger 30 is normally held in extended position with respect to the rear face 64 of the main body 18 due to the biasing action of the spring 58. This spring operates between the stepped ledge 65, located between the larger and smaller diameter bores, 54 and 56, of the main body, and the stepped ledge 67 located between the central and smaller diameter portions, 50 and 48, of the plunger shaft.

As represented in dashed lines in FIG. 2, the plunger can be moved relative to the main body to a depressed position. In this movement, the maximum distance 66 that the gate 28 can shift on the pin 22 is equal to the distance 68 that the retainer 32 can freely slide on the plunger shaft, in its operative first position, before catching the rear face 64 of the main body. This distance 66 is intentionally made too small for the gate 28 to clear the pin 22, so that the retainer acts as a security element keeping the swivel locked until being deactivated. In particular, while the retainer is in its operative first position on the smooth-faced, smaller-diameter portion 48 of the plunger, the retainer may freely spin, in either direction, under the influence of external forces, without being compelled into an axial movement along the plunger that would enlarge the maximum gate-shifting distance 66.

Figure 3:
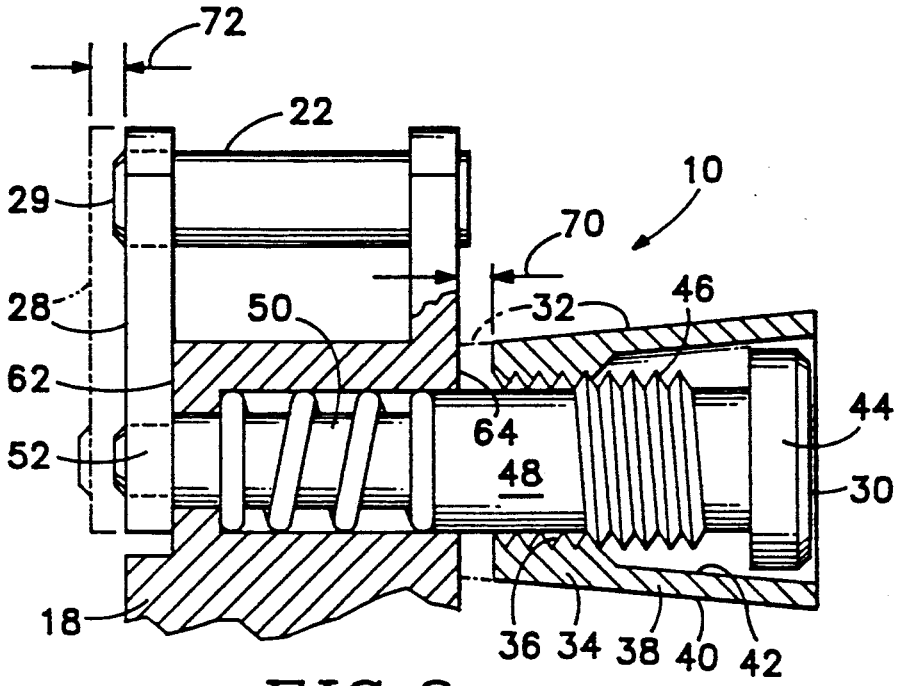
FIG. 3 is a fragmentary view of a selected portion of the swivel shown in FIG. 2, showing threaded portions of the security element and the plunger that are in mated engagement with each other.

Referring now to FIG. 3, by simultaneously pulling on and rotating the retainer, the user can thread the retainer 32 into a mated position on the plunger 30, as shown. Here the internally-threaded bore 36 defined in the forward portion 34 of the retainer mates with the fine-pitched threaded portion 46 of the plunger. After initial placement into the mated position shown, the retainer remains operable and keeps the swivel 10 locked. This is represented in dashed lines in FIG. 3, which shows that when the plunger 30 is urged into its depressed position on the main body, the retainer 32 engages the rear face 64 of the body after moving a distance 70, thereby constraining movement of the gate 28 to an equal distance 72 insufficient in length to clear the pin 22.

Figure 4:
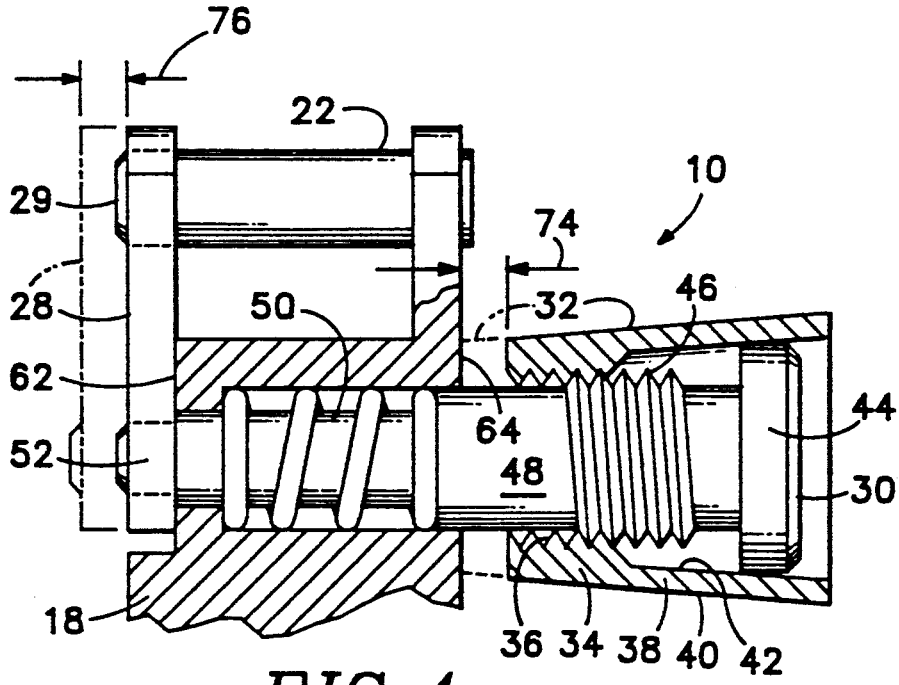
FIG. 4 is similar to FIG. 3, and shows that further manipulation of the security element has placed it barely into a position where it is opposed by an enlarged head on the plunger.

Referring now to FIG. 4, with continued turning of the retainer 32 on the plunger 30 the user can move the retainer 32 along the fine-pitched threaded portion 46 of the plunger into an opposed position as shown. Here the tapered interior 42 of the skirt or sleeve portion 38 of the retainer is interferingly engaged by the enlarged head 44 of the plunger. After initial placement into the opposed position shown, the retainer still continues to remain operable and to keep the swivel 10 locked. This is represented in dashed lines in FIG. 4, showing that when the plunger is depressed toward the main body, the retainer 32 engages the rear face of the body after moving a distance 74, thereby constraining movement of the gate 28 to an equal distance 76 insufficient in length to clear the pin 22.

Figure 5:
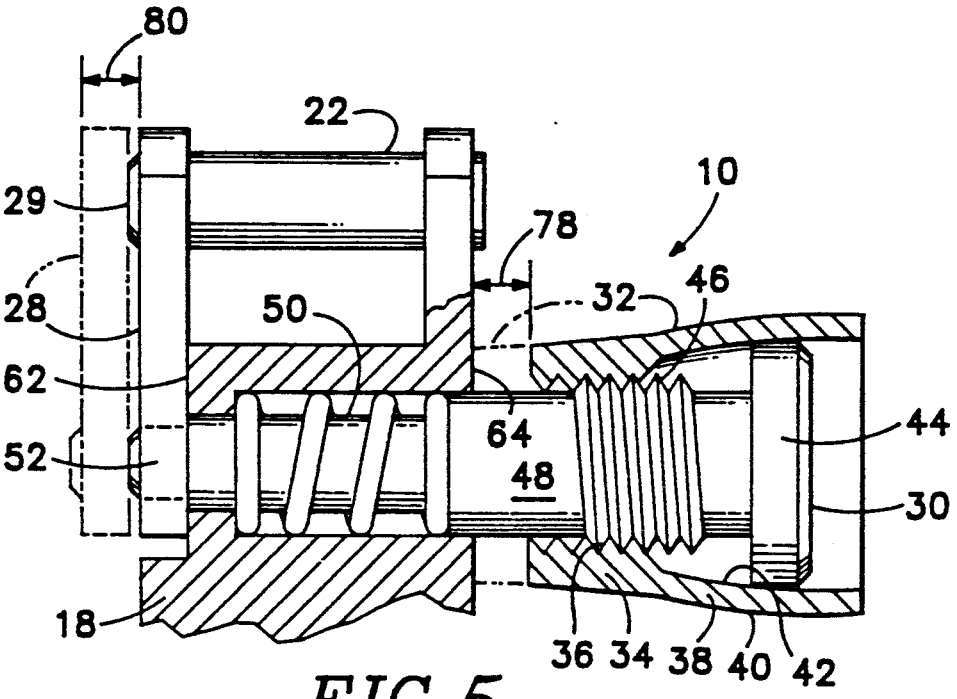
FIG. 5 is similar to FIG. 4, and shows that further manipulation of the security element has caused the tapered interior of the retainer to expand outwardly on the enlarged head of the plunger.

Referring now to FIG. 5, by continuing to turn the retainer 32 on the plunger 30, the user can axially move the retainer into an inoperative second position as shown. Viewing FIGS. 4 and 5 together, outward movement of the retainer from its opposed position in FIG. 4 to its inoperative second position in FIG. 5 causes the tapered interior 42 of the retainer to expand elastically outward setting up a resistance that opposes, and ultimately limits, outward movement of the retainer. In particular, as the degree of elastic expansion of the tapered interior increases with outward movement of the retainer, the opposing resistance also increases, so that the user must apply progressively increasing amounts of torque to the retainer 32 to advance it to the inoperative second position.

Once placed into the inoperative second position shown, the retainer allows the swivel 10 to be unlocked. This is represented in dashed lines in FIG. 5, which shows that when the plunger 30 is depressively urged into its releasing position, the retainer 32 engages the rear face 64 of the main body 18 after moving a distance 78, thereby permitting movement of the gate 28 an equal distance 80 sufficient in length to clear the pin 22. After the gate 28 is shifted off the pin and swung downwardly out of the plane of the drawing, and as the plunger 30 is returned to its elevated position shown in solid lines, the swivel 10 assumes the condition shown in FIG. 6 for mounting to or demounting from the firearm.

It can now be seen how the exemplary swivel 10 described herein meets all of the objects and advantages set forth above. In particular, it will be recognized that undetected deactivation of the retainer 32, which keeps the swivel 10 securely locked, is prevented by the functional nonresponsiveness of the retainer to incremental-type unidirectional rotation while in its operative first position, by the specific act of user intervention needed to mate the threads of the retainer with those of the plunger, by the continued turning needed to advance the retainer to its opposed position, and by the progressively increasing torque needed to drive the retainer to its inoperative second position.

While a preferred embodiment of the invention has been described, it will be recognized that alternative forms of the invention are possible within the broader principles of the present invention. For example, although a pin 22 and gate 28 have been described for attaching the swivel 10 to the mounting base 14, many other attachment mechanisms are possible.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A quick-detachable firearm sling swivel, comprising:

(a) a body;

(b) selectively openable attachment means operatively associated with said body, for attaching said sling swivel to a mounting base;

(c) plunger means for opening said attachment means, said plunger means including a plunger interconnected with said attachment means and attached movably to said body so as to be movable with respect to said body between an extended position, in which said attachment means is in a secured condition, and a releasing position, in which said attachment means is openable to permit said sling swivel to be attached to or removed from said mounting base; and (d) security means mounted on said plunger for selectively preventing said plunger from being moved to said releasing position, said security means being movable on said plunger between an operative first position, wherein said security means is rotatable on said plunger without moving axially therealong and wherein said security means prevents said plunger from being moved to said releasing position, and an inoperative second position wherein said security means is displaced axially of said plunger from said operative first position, and wherein said security means does not prevent said plunger from being moved to said releasing position.

2. The sling swivel of claim 1 wherein said security means includes a retainer defining a threaded bore, and wherein said plunger includes a shaft, said shaft including a smaller-diameter portion and a larger-diameter threaded portion, said threaded bore being mated with said threaded portion when said security means is in said inoperative second position.

3. The sling swivel of claim 2 wherein said retainer is located adjacent said body and is rotatable about said shaft of said plunger without moving axially therealong, when said security means is in said operative first position.

4. The sling swivel of claim 2 wherein said plunger includes a head and said retainer includes a sleeve, at least one of said head and said sleeve being tapered, and a portion of said sleeve fitting around said head so as to limit movement of said retainer axially along said shaft of said plunger when said security means is in said inoperative second position.

5. The sling swivel of claim 4 wherein said sleeve defines a tapered interior and is of elastically expansible material, said sleeve fitting around said head so as to selectively provide resistance to movement of said retainer axially along said shaft of said plunger toward said inoperative second position of said security means.

6. The sling swivel of claim 3 including means interposed between said retainer and said shaft of said plunger for providing resistance to movement of said retainer axially along said shaft of said plunger, said resistance increasing with axial movement of said retainer away from said operative first position of said security means.

* * * * *